US006346673B1

(12) United States Patent
Onizuka

(10) Patent No.: US 6,346,673 B1
(45) Date of Patent: Feb. 12, 2002

(54) NOISE PREVENTING SPLIT FERRITE CORE

(75) Inventor: Masahiro Onizuka, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/454,528

(22) Filed: Dec. 6, 1999

(30) Foreign Application Priority Data

Dec. 7, 1998 (JP) ..... 10-361968

(51) Int. Cl.[7] ..... H01B 11/06

(52) U.S. Cl. ..... 174/36; 174/92; 174/117 F; 336/92

(58) Field of Search ..... 174/92, 36, 117 F; 336/92, 175, 176; 333/12

(56) References Cited

U.S. PATENT DOCUMENTS

| | | | | | |
|---|---|---|---|---|---|
| 4,656,450 | A | * | 4/1987 | Jarosz et al. | 336/92 X |
| 5,095,296 | A | | 3/1992 | Parker | 336/92 |
| 5,343,184 | A | * | 8/1994 | Matsui et al. | 336/92 |
| 5,537,087 | A | * | 7/1996 | Naito | 336/92 |
| 5,821,845 | A | * | 10/1998 | Ohashi | 336/92 |
| 5,990,756 | A | * | 11/1999 | France, Jr. et al. | 333/12 |

FOREIGN PATENT DOCUMENTS

| | | |
|---|---|---|
| JP | 1-73905 | 5/1989 |
| JP | 2-49194 | 4/1990 |
| JP | 2-120898 | 9/1990 |
| JP | 5-90779 | 4/1993 |

OTHER PUBLICATIONS

U.S. application No. 09/261,228, filed Mar. 3, 1999, allowed.

U.S. application No. 09/453,517, filed Dec. 3, 1999, pending.

U.S. application No. 09/454,528, filed Dec. 6, 1999, pending.

* cited by examiner

*Primary Examiner*—Chau N. Nguyen
(74) *Attorney, Agent, or Firm*—Oblon, Spivak, McClelland, Maier & Neustadt, P.C.

(57) ABSTRACT

A split ferrite core including first and second split ferrite cores. The first split ferrite core body includes first and second leg portions, and the first leg portion is vertical with respect to the second leg portion. The second split ferrite core body includes third and forth leg portions, and the third leg portion is vertical with respect to the forth leg portion. The first leg portion of the first split ferrite core body abuts against the forth leg portion of second split ferrite core body, and the second leg portion of the first split ferrite core body abuts against the third leg portion of second split ferrite core body.

20 Claims, 13 Drawing Sheets

NOISE PREVENTING SPLIT FERRITE CORE

BACKGROUND OF THE INVENTION

1. Field of the Invention

The present invention relates a noise preventing split ferrite core for a flat cable which is used to suppress not only noise conducting through the flat cable but also noise radiating therefrom and a noise preventing component, a wiring harness and an electronic apparatus which adopt therein the same noise preventing split ferrite core.

2. Description of the Related Art

Conventionally, in order to prevent noise from various types of electronic apparatus, for example, personal computers, a ferrite core is mounted on a cable connecting electronic apparatus. There are cables of various configurations and a flat cable is one of them. A ferrite core is, of course, mounted on such a flat cable for prevention of noise therefrom.

As a ferrite core for noise prevention from a flat cable, a ferrite core 1 shown in FIG. 12 has been used for that purpose and the ferrite core 1 has an inside diameter (or an inner sectional configuration) having a flat O-shaped (or a flat ring-like) configuration which corresponds to the outside diameter (or the outer sectional configuration) of a flat cable FC.

Moreover, a split ferrite core shown in FIG. 13 has also been used to facilitate attachment to and detachment from a flat cable. In this case, the ferrite core 1 is constructed such that the flat cable FC is held between split ferrite core bodies 1*a*, 1*b* which are abutted against each other.

A ferrite core attached to a flat cable needs to be fixed at an attached position such that the ferrite core does not move along the flat cable. This is because, if a ferrite core moves over a flat cable in an electronic apparatus after it is attached to the flat cable, the ferrite core comes into collision with a housing or component of the apparatus that is located adjacent thereto, this possibly leading to a failure of the ferrite core or a failure inside the electronic apparatus. In addition, the noise eliminating effect of the ferrite core differs depending on its position on the flat cable and therefore a change in the position of the ferrite core on the flat cable may affect the noise eliminating effect of the ferrite core. Thus, an optimum noise eliminating effect may not be obtained when the ferrite core moves over the flat cable.

As methods for fixing the ferrite core on the flat cable that have been used heretofore, in some cases the ferrite core and the flat cable are fixed to each other with an adhesive, an adhesive tape or the like, while in other cases the ferrite core is fixed to the housing of the electronic apparatus or on a substrate of the electronic apparatus which are located in proximity thereto.

However, these methods require labor hours. In particular, when an adhesive is used, a certain length of time is required before it sets up, and the ferrite core needs to be held at a position where it should be fixed until the adhesive is solidified. Thus, this method is disadvantageous in that a long production lead time is required. Moreover, with this method using an adhesive, if the ferrite core happens to be required to be removed for some reason, for instance, due to occurrence of a failure or defect in the ferrite core after it is fixed or occurrence of a disconnection of or defect in the flat cable, the ferrite core cannot be detached after the set adhesive is first removed and such work requires an extremely great deal of labor hours. In particular, where the flat cable and the ferrite core are secured to each other with an adhesive, there may be caused a failure in the coating of the flat cable or a disconnection of the flat cable while the adhesive is being removed, and if this happens, there may be caused a risk of the ferrite core and the flat cable being discarded.

With a view to overcoming a drawback as described above, components as shown in FIG. 14 are proposed for fixing the ferrite core (produced by TOKIN under a trade name of FPD-CL-1 Camp) of an integral-type. This component 5 is characterized in that it is attached to end surfaces of end portions of a ferrite core 1, respectively, and that it can be fixed onto an electronic apparatus housing or a substrate 10 with a screw 7 and a nut 8 using a hole 6 formed in the component 5.

However, workability in attaching the ferrite core 5 to the electronic apparatus housing or the substrate 10 with the screw 7 and the nut 8 is not necessarily good. For instance, when trying to attach the ferrite core 1 to the electronic apparatus housing or the substrate 10 with the components 5, first of all, the components 5 are mounted on the ferrite core 1, and thereafter the ferrite core is fixed to the housing or the substrate 10 while the components 5 have to be held in the mounted positions by hand so that they should not come off the ferrite core. In addition, where the ferrite core 1 is removed after it has once been fixed in place, the ferrite core 1 cannot be removed before the whole set of the core and components are detached from the substrate. Moreover, since the ferrite core 1 used together with the components 5 is of an integral type, the ferrite core 1 has to be attached to a flat cable FC before a connection of the flat cable FC is completed, in other words, for instance, before a terminal is connected to the flat cable FC or the flat cable FC is connected to the electronic apparatus, and even if the ferrite core or the flat cable so attached has to be replaced for some reason, for instance, due to a failure or a defect in the ferrite core or a disconnection or a defect of the flat cable, the ferrite core or the flat cable cannot be replaced with ease, thus the working efficiency being deteriorated.

On the contrary, in the case of a split ferrite core, the ferrite core can be attached to the flat cable in any stage. In addition, the core can be detached from the cable with ease due to the construction of the split ferrite core. However, as with the integral-type ferrite core, if the fixing method is used in which an adhesive or an adhesive tape is used as a fixing means, there are caused the same problems as those inherent in the integral-type ferrite core.

With a view to overcoming the above drawback, a component as shown in FIGS. 15 and 16 is proposed (produced by Kitagawa Kogyo under a trade name of EFC-40-N/S, disclosed on page 14 of the "EMI Preventing Ferrite Technical Information") for split ferrite core. This component 15 is characterized in that a case 16 is provided with a function to cover a ferrite core 1 by split ferrite core bodies 1*a*, 1*b* which are abutted against each other.

However, provision of such a function to the case 16 ends in a complicated construction and higher costs. In addition, since the inside diameter of the split ferrite core bodies 1*a*, 1*b* cannot be varied, it is not possible to hold the flat cable between the split ferrite core bodies 1*a*, 1*b* so securely that the ferrite core is not allowed to move thereover; therefore, a bottom of the component 15 needs to be fixed to an electronic apparatus housing or a substrate with a tape with adhesives on both sides or an adhesive.

Furthermore, in the case of conventional integral-type or split ferrite cores, they are selected such that the inside diameter (or the inner sectional configuration) thereof matches the dimensions of a flat cable inserted thereinto. The ferrite core can provide a better noise eliminating effect as the impedance value becomes higher which is obtained when the flat cable is inserted through the ferrite core, and the magnitude of impedance is determined by the magnetic permeability and configuration of a material for the ferrite core. With the magnetic permeability of the material for the ferrite core remaining constant, an impedance value obtained is in proportion to the effective sectional area of the ferrite core and is in inverse proportion to the length of an effective magnetic path. Therefore, it is desirable to select a ferrite core having a configuration which can provide as wide an effective sectional area as possible and as short an effective magnetic path as possible. In general, since a ferrite core having a larger outside diameter and a smaller inside diameter meets the above requirement, a ferrite core is selected for use which has an inside diameter that is as close to the dimensions of a flat cable to be used as possible.

However, there are many flat cables of various dimensions, and it is difficult to produce ferrite cores which can match those flat cables, respectively. Therefore, in reality, a ferrite core which is produced for use for a flat cable of certain dimensions is used for a flat cable which is smaller than the intended flat cable. In addition, there are some allowable tolerances in relation to the dimensions of ferrite cores; therefore, it is normal to select a ferrite core having a configuration in which a minimum value for the inside diameter of the ferrite core is larger than the dimensions of a flat cable which is put therethrough.

Thus, it is extremely difficult to select a ferrite core having an inside diameter which is extremely close to the dimensions of a flat cable, and it has been difficult to select a ferrite core that allows a flat cable which is used together to obtain an optimum impedance.

SUMMARY OF THE INVENTION

In order to solve the above-described problems, a first object of the present invention is to provide a noise preventing split ferrite core for a flat cable and a noise preventing component that are easy to be attached to, detached from and fixed to a flat cable and, therefore, which can be adapted to cope with flat cables of various dimensions to thereby eliminate noise in an effective fashion.

A second object of the present invention is to provide a wiring harness and an electronic apparatus in which a split ferrite core is attached to a flat cable which is easy to be attached to, detached from and fixed to a flat cable and therefore which can be adapted to cope with flat cables of various dimensions to thereby eliminate noise in an effective fashion.

Other objects and novel features of the present invention will be made apparent as modes of carrying out the present invention are described later.

With a view to attaining the above objects, a split ferrite core, especially for a noise prevention from a flat cable, according to the present invention comprises first and second split ferrite core bodies. The first split ferrite core body includes first and second leg portions, and the first leg portion is substatially vertical with respect to the second leg portion. The second split ferrite core body includes third and forth leg portions, and the third leg portion is substatially vertical with respect to the forth leg portion. The first leg portion of the first split ferrite core body abuts against the forth leg portion of second split ferrite core body, and the second leg portion of the first split ferrite core body abuts against the third leg portion of second split ferrite core body. With the above-mentioned construction of split ferrite core, a closed magnetic path is formed.

A noise preventing component according to the present invention comprises a split ferrite core and at least one fixing component. The split ferrite core includes first and second split ferrite core bodies. The first split ferrite core body includes first and second leg portions, and the first leg portion is substatially vertical with respect to the second leg portion. The second split ferrite core body includes third and forth leg portions, and the third leg portion is substatially vertical with respect to the forth leg portion. The first leg portion of the first split ferrite core body abuts against the forth leg portion of second split ferrite core body, and the second leg portion of the first split ferrite core body abuts against the third leg portion of second split ferrite core body. The fixing component holds the split ferrite core body assembled. With the above-mentioned construction of noise preventing component, a closed magnetic path is formed, and fixing components holds the split ferrite core in an assembled state.

A wiring harness according to the present invention comprises a flat cable, a split ferrite core and at least one fixing component. The split ferrite core surrounds said flat cable, and said split ferrite core includes first and second split ferrite core bodies. The first split ferrite core body includes first and second leg portions, and the first leg portion is substantially vertical with respect to the second leg portion. The second split ferrite core body includes third and forth leg portions, and the third leg portion is substantially vertical with respect to the forth leg portion. The first leg portion of the first split ferrite core body abuts against the forth leg portion of second split ferrite core body, and the second leg portion of the first split ferrite core body abuts against the third leg portion of second split ferrite core body. The fixing component holds the split ferrite core body together. With the above-mentioned construction of split ferrite core, a closed magnetic path is formed.

An electronic apparatus according to the present invention comprises a flat cable, a split ferrite core and at least one fixing component. The split ferrite core surrounds said flat cable, and said split ferrite core includes first and second split ferrite core bodies. The first split ferrite core body includes first and second leg portions, and the first leg portion is substantially vertical with respect to the second leg portion. The second split ferrite core body includes third and forth leg portions, and the third leg portion is substantially vertical with respect to the forth leg portion. The first leg portion of the first split ferrite core body abuts against the forth leg portion of second split ferrite core body, and the second leg portion of the first split ferrite core body abuts against the third leg portion of second split ferrite core body. The fixing component holds the split ferrite core body together. With the above-mentioned construction of split ferrite core, a closed magnetic path is formed.

In the present invention, the split ferrite core bodies are formed, for example, into a L-shape, respectively, and they are adapted to be assembled together so as to form a closed magnetic path. In this construction, inside diameters of the assembled ferrite core bodies can be changed in any fashion with respect to width and thickness directions of the flat cable, and therefore with a small variety of ferrite core configurations, it is possible to cope with flat cables of various widths and thicknesses.

Moreover, as described above, in general, it is believed that the impedance of a ferrite core is in proportion to the effective sectional area thereof and is in inverse proportion to the effective magnetic path thereof, but in the case of the split ferrite core bodies formed in L-shaped or the like, since the effective magnetic path thereof can be made shorter by narrowing the inside diameter of the ferrite core bodies in either the width or the thickness direction of the flat cable with the effective sectional area being kept constant, the impedance of the ferrite core bodies can be increased, whereby noise can effectively be eliminated from the flat cable.

In addition, according to the present invention, it is possible to provide the noise preventing component that can easily be attached to and/or detached from the flat cable by using the assembled split ferrite core bodies, for example, L-shaped, and the fixing components for fixing the assembled ferrite core bodies together.

Moreover, according to the present invention, the fixing components for fixing the split ferrite core bodies together can produce a force acting in the inside diameter direction of the assembled split ferrite core bodies, a force is in turn produced for allowing the split ferrite core bodies to hold the flat cable therebetween, thereby making it possible to fix the split ferrite core so attached to the flat cable to such an attached position. When comparing this construction with the construction in which an adhesive or an adhesive tape is used, the present invention can provide a better work efficiency.

Furthermore, the split ferrite core can be attached to and/or detached from the flat cable more easily by combing the noise preventing component with the closable case which can accommodate therein the split ferrite core. In addition, with the ferrite core being accommodated in the case, even if a direct impact is applied to the case, no direct impact is applied to the ferrite core, and therefore it is possible to prevent a damage to the ferrite core.

Moreover, irrespective of the construction of the case, there is provided a two-part case or an integral-type case comprising two case bodies which are connected to each other at a hinge portion, and in either of the two cases, the split ferrite core bodies, for example L-shaped, are accommodated, respectively, in the two case bodies. In addition, it is preferable to provide a pawl portion at a position where the split ferrite core body is accommodated for preventing the split ferrite core body from being detached therefrom. Also, it is preferable to provide a spring portion for obtaining a force with which the split ferrite core bodies hold the flat cable therebetween.

Irrespective of the material of the fixing component or the case for the ferrite core, a metal or a resin can be used as a material therefor. In addition, when used for the fixing component or the case, a material which has a certain degree of flexibility or elasticity can produce a force with which the split ferrite core bodies can hold the flat cable therebetween, and therefore it is preferable to use such a material for the fixing component or the case. Moreover, for the case, it is preferable to use a material, such as a resin in particular, that can absorb an impact applied thereto.

In the case of the ferrite core comprising the split ferrite core bodies which are combined with each other as described above, if it has dimensions allowing the core to cope with a flat cable of maximum dimensions, the ferrite core can cope with flat cables of dimensions smaller than the maximum ones. Due to this, when considering a manufacturer of ferrite cores, only a single configuration has to be prepared for a mold, which is for the ferrite core that can cope with the flat cable of maximum dimensions, this serving not only to reduce the production costs but also to facilitate the management of production.

Furthermore, with the wiring harness comprising the noise preventing split ferrite core or the noise preventing component for a flat cable according to the present invention in which the split ferrite core bodies, for example, L-shaped, are assembled together and a flat cable which is combined with the core or component, since a noise preventing means is provided in advance for the flat cable, the wiring harness can be installed in an electronic apparatus with good efficiency.

Moreover, with the electronic apparatus adopting the aforesaid noise preventing split ferrite core or noise preventing component and the flat cable combined with the core or component, the ferrite core can easily be attached to the flat cable, and since the ferrite core is fixed to the flat cable sufficiently securely, there is caused no risk of the ferrite core moving over the flat cable due to vibrations applied to the apparatus, thereby making it possible to secure a position where an optimum noise elimination can be effected.

DETAILED DESCRIPTION OF THE PREFERRED EMBODIMENTS

Referring to the accompanying drawings, described below will be modes of carrying out the present invention in which a noise preventing split ferrite core for a flat cable, and a noise preventing component, a wiring harness and an electronic apparatus which each use therein the noise preventing split ferrite core according to the present invention are described.

Figure 1A:
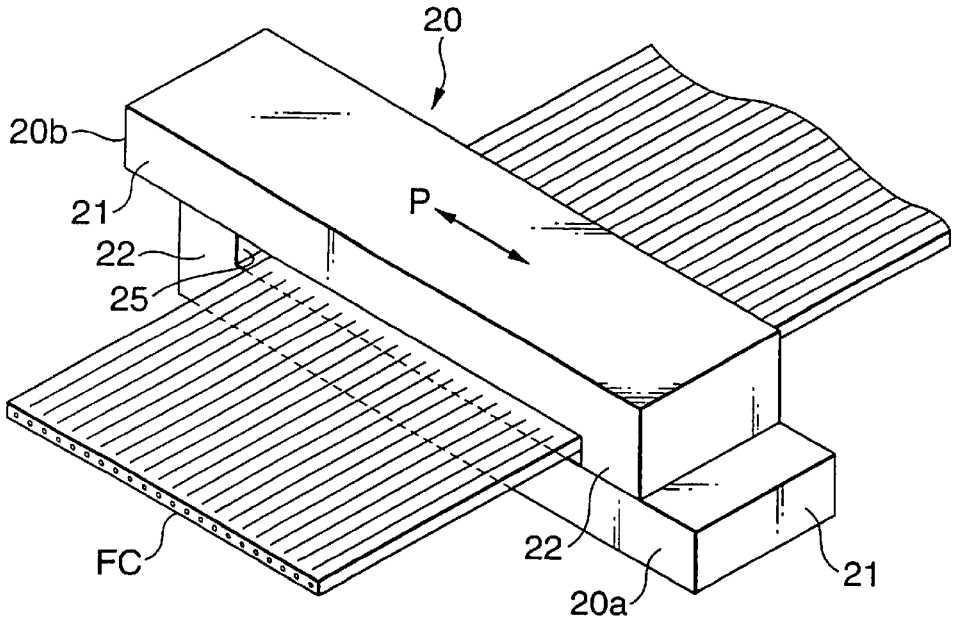
FIGS. 1A–1C are perspective views of a first embodiment of the present invention.
Figure 1B:
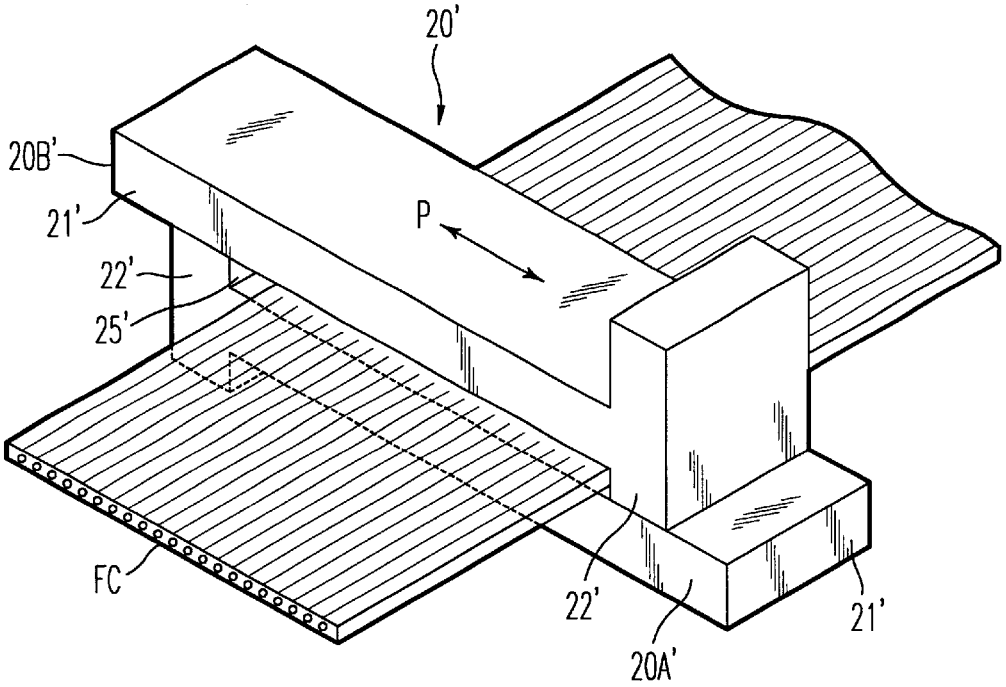
Figure 1C:
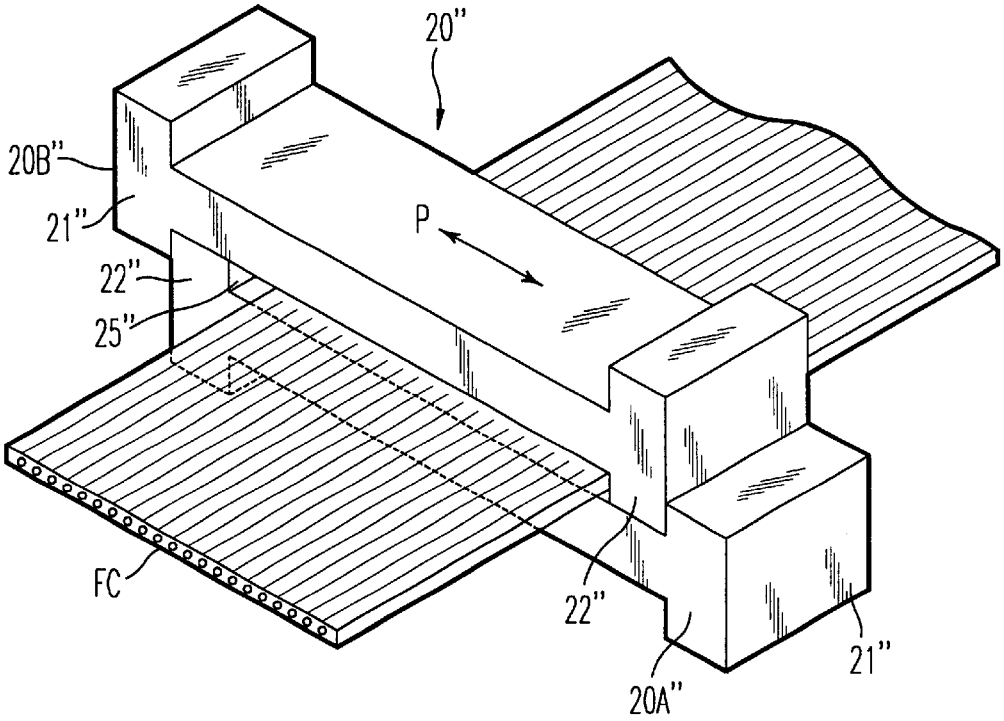

FIGS. 1A–C illustrates a first embodiment of the present invention in which a noise preventing split ferrite core for a flat cable is shown. As shown in the FIGS., L-shaped. (FIG. 1A), T-shaped (FIG. 1B), and I-shaped (FIG. 1C) split ferrite core bodies 20*a*, 20*a*', 20*a*", 20*b*, 20*b*', 20*b*" for a flat cable are each an L-shaped T-shaped or I-shaped plate-like body having a shorter leg portion 22, 22', 22" which is bent at right angles relative to a longer leg portion 21, 21', 21 ". The split ferrite core 20, 20', 20" is an integrated body comprising the two L-shaped, T-shaped or I-shaped split ferrite core bodies which are assembled together in such a manner that an end face of the shorter leg portion 22, 22', 22" of one of the L-shaped, T-shaped or I-shaped split ferrite core bodies, which is the L-shaped, T-shaped or I-shaped split ferrite core body 20*a*, 20*a*', 20*a*" abuts against a side of the longer leg portion 21, 21', 21 " of the other L-shaped, T-shaped or I-shaped split ferrite core body 20*b*, 20*b*', 20*b*" while an end face of the shorter leg portion 22, 22', 22" of the other L-shaped, T-shaped, I-shaped split ferrite core body 20*b*, 20*b*', 20*b*" abuts against a side of the longer leg portion 21, 21', 21 " of the one of the L-shaped, T-shaped or I-shaped split ferrite core bodies, which is the L-shaped, T-shaped or I-shaped split ferrite core body 20*a*, 20*a*', 20*a*" so as to form a closed magnetic path. A flat cable FC is put through a slit-like through-hole portion (an inside diameter portion) 25, 25', 25" of the assembled L-shaped split ferrite core bodies, and the relative positions of the respective L-shaped, T-shaped or I-shaped split ferrite core bodies 20*a*, 20*a*', 20*a*", 20*b*', 20*b*" are shifted in directions indicated by arrows P so as to adjust the transverse width of the slit-like through hole portion 25, 25', 25" such that it becomes equal to the transverse width of the flat cable FC. When this is carried out, it is important that surfaces of the L-shaped, T-shaped or I-shaped split ferrite core bodies which are normal to a direction of a magnetic flux of the I-shaped, T-shaped or I-shaped ferrite core bodies 20*a*, 20*a*', 20*a*", 20*b*, 20*b*', 20*b*" are brought into as tight a contact as possible with each other. With a gap being produced between the contact surfaces of the L-shaped, T-shaped, or I-shaped split ferrite core bodies 20, 20*a*', 20*a*", 20*b*, 20*b*', 20*b*", the effective magnetic permeability of the ferrite core 20, 20', 20" constituted by the two assembled L-shaped, T-shaped or I-shaped split ferrite core bodies is reduced, this leading to reduction in the impedance thereof Therefore, it is preferable that the surface roughness of the contact surfaces of the L-shaped, T-shaped or I-shaped, split ferrite core bodies 20*a*, 20*a*', 20*a*", 20*b*, 20*b*', 20*b*" is as small as possible (for instance, as with a mirror surface condition) so that the two core bodies can be brought into a tight contact with each other. In addition, in here, the side of the leg portion is referred to any of four sides of the leg portions which are adjacent and normal to an end face thereof.

According to the noise preventing split ferrite cores for a flat cable illustrated in this first embodiment of the present invention, the following advantages can be obtained.

(1) The split ferrite core bodies 20*a*, 20*a*', 20*a*", 20*b*, 20*b*', 20*b*" are each formed into an L-shape, T-shaped or I-shaped, and they are assembled together in such a manner that the end face of the shorter leg portion 22, 22', 22" of the one of the L-shaped, T-shaped or I-shaped split ferrite core bodies abuts against the side of the longer leg portion 21, 21', 21" of the other L-shaped, T-shaped or I-shaped split ferrite core body so as to form a closed magnetic path therebetween, and the inside diameter of the assembled L-shaped, T-shaped or I-shaped split ferrite core bodies which corresponds to the transverse width of the flat cable FC can be arbitrarily changed. Thus, according to this construction, it is possible to cope with flat cables of various transverse widths with a few ferrite core configurations. In addition, attachment and fixation of the ferrite core 20, 20', 20" to the flat cable can be facilitated by holding the flat cable with the split ferrite core bodies 20*a*, 20*a*', 20*b*, 20*b*' therebetween.

(2) The split ferrite core 20 is constituted by the L-shaped, T-shaped or I-shaped split ferrite core bodies 20*a*, 20*a*', 20*a*", 20*b*, 20*b*', 20*b*" and the length of the effective, magnetic path of the ferrite core 20, 20', 20" can be made shorter by narrowing the inside diameter thereof in the transverse width direction of the flat cable FC with the effective sectional area thereof being kept constant, Thus, according to this construction, the impedance of the ferrite core can be increased, thereby making it possible to eliminate noise from the flat cable FC in an effective fashion.

(3) The L-shaped, T-shaped or I-shaped split ferrite core bodies 20*a*, 20*a*', 20*a*", 20*b*, 20*b*', 20*b*" may be assembled together and attached to the flat cable FC in such a manner that the split ferrite core bodies put the flat cable FC therebetween, and this facilitates attachment of the ferrite core to and detachment thereof from the flat cable.

(4) In the case of the ferrite core 20, 20', 20" comprising the L-shaped, T-shaped or I-shaped split ferrite core bodies 20*a*, 20*a*', 20*a*", 20*b*, 20*b*', 20*b*" which are combined with each other, if the ferrite core is constructed so as to have dimensions which allow the same core to cope with a flat cable of maximum dimensions, the ferrite core so constructed can cope with flat cables having dimensions smaller than the maximum ones. Thus, with this construction, when considering a manufacture of ferrite cores, only a single configuration has to be prepared therefor. This does not only reduce the production costs, but also facilitates the management of production.

Figure 2A:
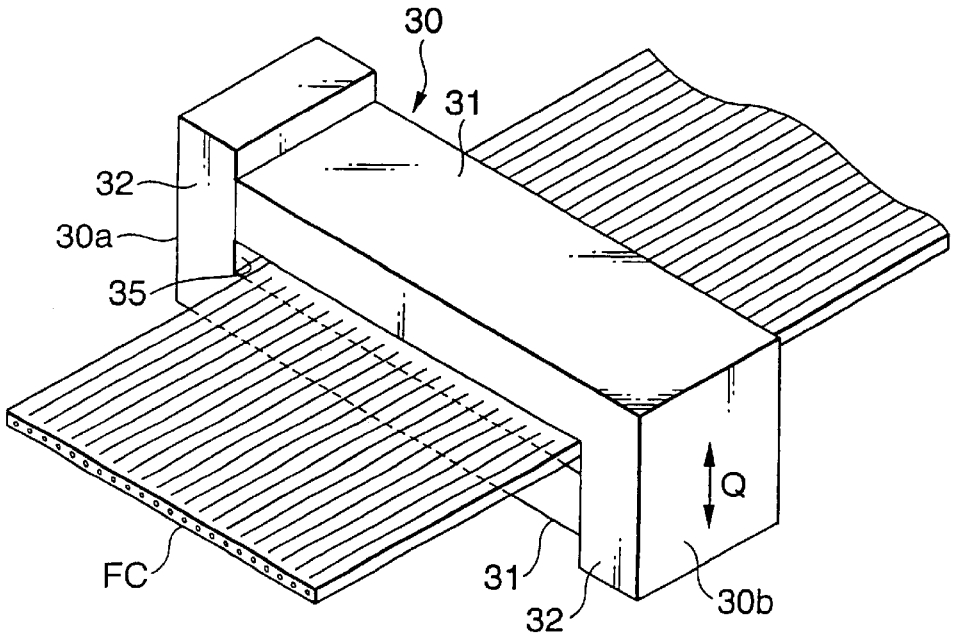
FIGS. 2A–2B are perspective views of a second embodiment of the present invention.
Figure 2B:
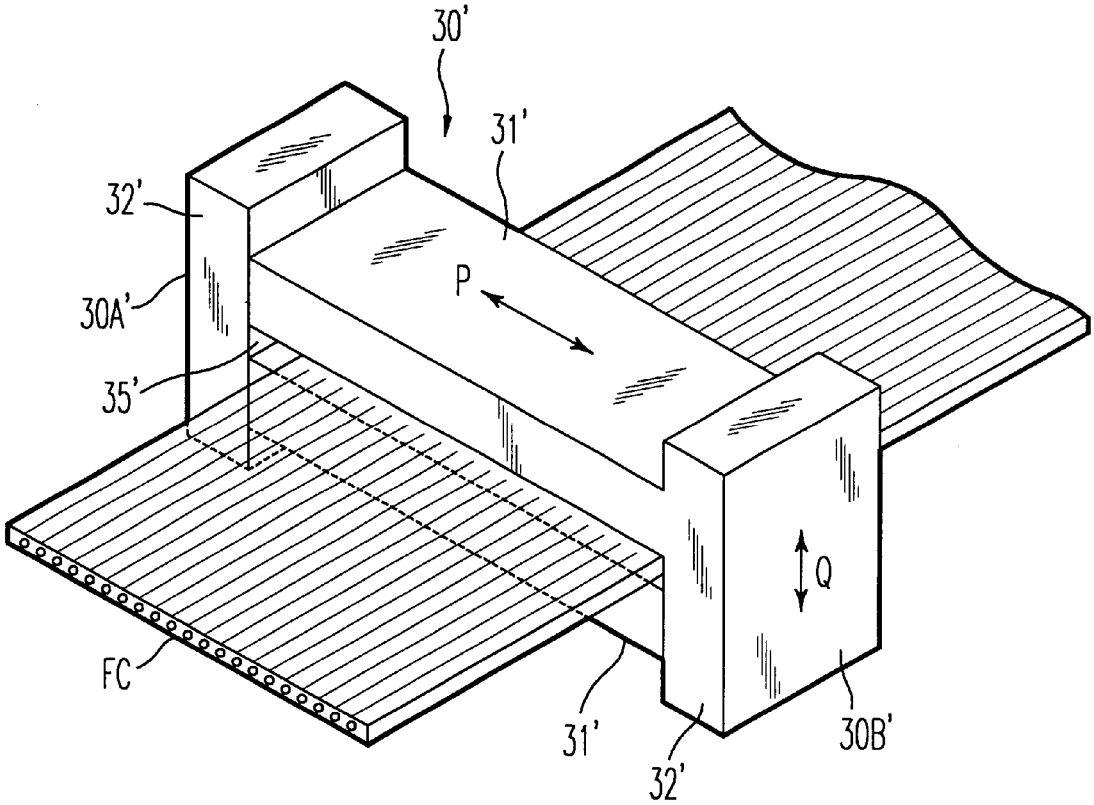

FIGS. 2A–B illustrates a second embodiment of the present invention in which two other noise preventing split ferrite core for a flat cable is shown. As shown in the figures these noise preventing split ferrite cores 30, 30' are integrated bodies comprising the four L-shaped split ferrite core bodies each which are assembled together in such a manner that an end face of a longer leg portion 31, 31' of one of L-shaped split ferrite core bodies, which is the L-shaped split ferrite core body 30*a*, 30*a*' abuts against a side of a shorter leg portion 32, 32' of the other L-shaped split ferrite core body 30*b*, 30*b*' while an end face of a longer leg portion 31, 31' of the other L-shaped split ferrite core body 30*b*, 30*b*' abuts against a side of a shorter leg portion 32, 32' of the one of the L-shaped split ferrite core bodies, which is the L-shaped split ferrite core body 30*a*, 30*a*' so as to form a closed magnetic path. A flat cable FC is put through a slit-like through-hole portion 35, 35' of the assembled L-shaped split ferrite core bodies, and the relative positions of the respective L-shaped split ferrite core bodies 30*a*, 30*a*', 30*b*, 30*b*' are shifted in directions indicated by arrows Q so as to adjust the dimension in a thickness direction of the slit-like through-hole portion 35, 35' such that it becomes equal to the thickness of the flat cable FC. When his is carried out, it is important that surfaces of the L-shaped split ferrite core bodies which are normal to a direction of a magnetic flux of the L-shaped split ferrite core bodies 30*a*, 30*a*', 30*b*, 30*b*' are brought into as tight a contact as possible with each other. With a gap being produced between the contact surfaces of; the L-shaped split ferrite core bodies

30*a*, 30*a*', 30*b*, 30*b*' the effective magnetic permeability of the ferrite core 30, 30' constituted by the two assembled L-shaped split ferrite core bodies is reduced, this leading to reduction in the impedance thereof. Therefore, it is preferable that the surface roughness of the contact surfaces of the L-shaped split ferrite core bodies 30*a*, 30*a*', 30*b*, 30*b*' is made as small as possible (for instance, as with a mirror surface condition) so that the two core bodies can be brought into a tight contact with each other.

In the case of the second embodiment of the present invention, the split ferrite core bodies 30*a*, 30*a*', 30*b*, 30*b*' are each formed into an L-shape, and the L-shaped split ferrite core bodies are assembled together in such a manner that the end face of the longer leg portion 31, 31' of one of the L-shaped split ferrite core bodies abuts against the side of the shorter leg portion 32, 32' of the other L-shaped split ferrite core body so as to form a closed magnetic path, and the inside diameter of the assembled L-shaped split ferrite core bodies which corresponds to the thickness direction of the flat cable FC can be arbitrarily changed. Thus, according to this construction, it is possible to cope with flat cables FC of various thicknesses with a few ferrite core configurations. In addition, the ferrite core 30, 30' can be attached to and detached from the flat cable with ease by holding the flat cable FC with the split ferrite core bodies 30*a*, 30*a*', 30*b*, 30*b*' therebetween, and when this is effected, a wide contact area can be taken between the split ferrite core 30, 30' and the flat cable FC, and this allows a great magnitude of fictional force to be generated therebetween, thereby increasing a force acting to fix the ferrite core to the flat cable. Other functions and advantages of this second embodiment the present invention are identical to those of the first embodiment.

Figure 3:
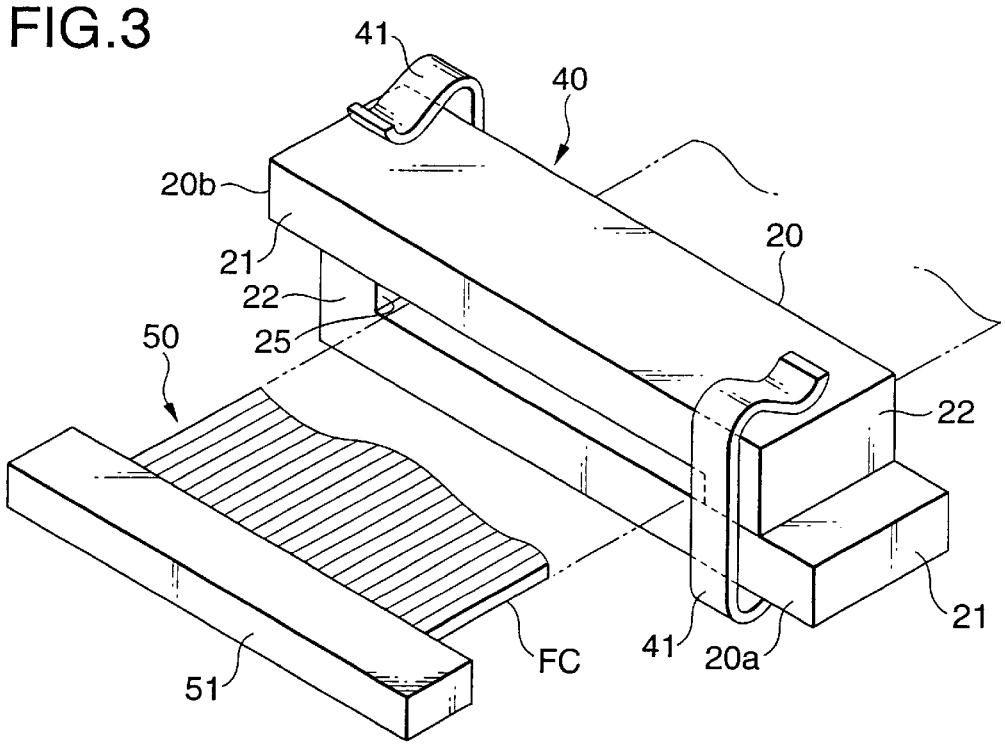
FIG. 3 is a perspective view of a third embodiment of the present invention.

FIG. 3 illustrates a third embodiment of the present invention in which a noise preventing component for a flat cable and a wiring harness are shown. As shown in the figure, the noise preventing component 40 for a flat cable is an integrated component comprising two L-shaped split ferrite core bodies 20*a*, 20*b* and fixing components 41, wherein the two L-shaped split ferrite core bodies 20*a*, 20*b* are assembled together so as to obtain a split ferrite core 20 in which a closed magnetic path is formed in such a manner that an end face of a shorter leg portion 22 of one of the L-shaped split ferrite core bodies, which is the L-shaped split ferrite core body 20*a*, abuts against a side of a longer leg portion 21 of the other L-shaped split ferrite core body 20*b*, while an end face of a shorter leg portion 22 of the other L-shaped split ferrite core body 20*b* abuts against a side of a longer leg portion 21 of the one of the L-shaped split ferrite core bodies, which is the L-shaped split ferrite core body 20*a*, and wherein the L-shaped split ferrite core bodies so assembled are clamped together with the fixing components 41. The fixing component 41 may be formed into any shape as long as it can produce a force for pressure clamping the L-shaped split ferrite core bodies 20*a*, 20*b* together, and although there is imposed no limitation to the material therefor, a metal or a resin that has a certain degree of elasticity is preferred.

The wiring harness 50 comprises a flat cable FC that is put through the slit-like portion 25 formed in the split ferrite core 20 of the noise preventing component 40, the flat cable FC being provided with a cable connector 51. Then, when this wiring harness 50 is installed in the housing of an electronic apparatus, the electronic apparatus can have a construction in which the split ferrite core 20 is held with fixing components 41 in a state in which the L-shaped split ferrite core bodies are assembled together so as to surround the flat cable FC in such a manner that the end face of the shorter leg portion of the one of the L-shaped split ferrite core bodies abuts against the side of the longer leg portion of the other L-shaped split ferrite core body so as to form a closed magnetic path.

According to this third embodiment of the present invention, the split ferrite core 20 can be fixedly held at an optimum position on the flat cable FC with the fixing components 41 by changing in any fashion the inside diameter of the slit-like through-hole portion 25 of the split ferrite core 20 that corresponds to the transverse width direction of the flat cable FC, whereby it is possible to cope with flat cables of various transverse widths with a few ferrite core configurations. In addition, adoption of the fixing components 41 produces an effect of clamping the flat cable FC which is put through the slit-like through-hole portion 25 of the L-shaped split ferrite core bodies 20*a*, 20*b* when these split ferrite core bodies are assembled together, and this functions to facilitate attachment of the split ferrite core 20 to the flat cable 20. Other constructions, functions and advantages of this third embodiment of the present invention are identical to those of the first embodiment.

Figure 4:
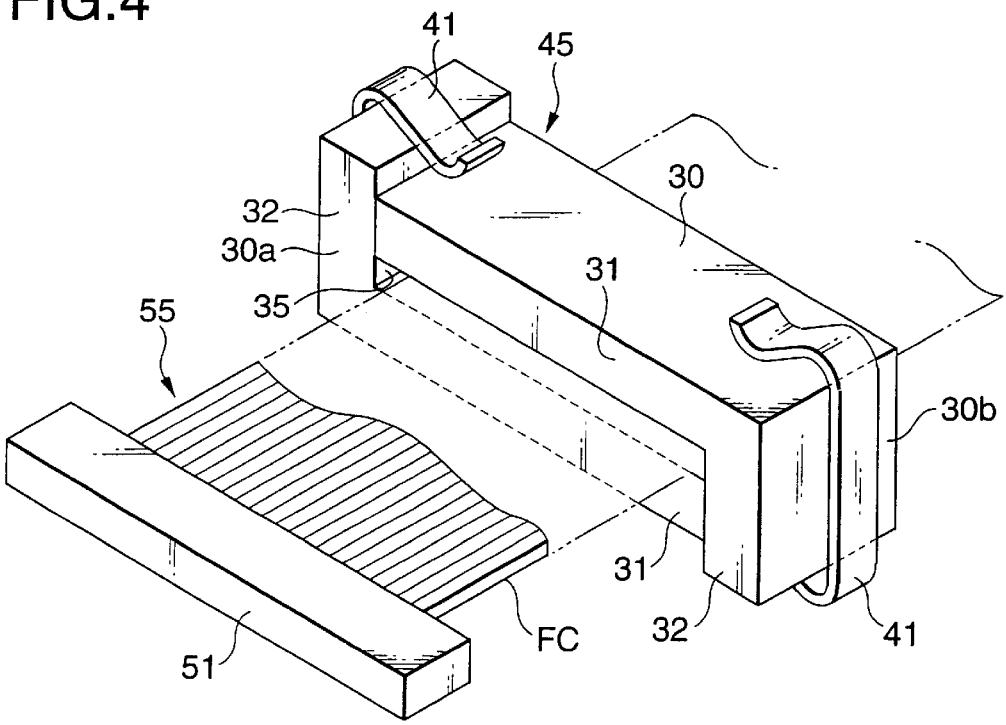
FIG. 4 is a perspective view of a fourth embodiment of the present invention.

FIG. 4 illustrates a fourth embodiment of the present invention in which another noise preventing component for a flat cable and another wiring harness are shown. As shown in the figure, the noise preventing component 45 for a flat cable is an integrated component comprising two L-shaped split ferrite core bodies 30*a*, 30*b* and fixing components 41, wherein the two L-shaped split ferrite core bodies 30*a*, 30*b* are assembled together so as to obtain a split ferrite core 30 in which a closed magnetic path is formed in such a manner that an end face of a longer leg portion 31 of one of the L-shaped split ferrite core bodies, which is the L-shaped split ferrite core body 30*a*, abuts against a side of a shorter leg portion 32 of the other L-shaped split ferrite core body 30*b*, while an end face of a longer leg portion 31 of the other L-shaped split ferrite core body 30*b* abuts against a side of a shorter leg portion 32 of the one of the L-shaped split ferrite core bodies, which is the L-shaped split ferrite core body 30*a*, and wherein the L-shaped split ferrite core bodies so assembled are clamped together with the fixing components 41. The fixing component 41 may be formed into any shape as long as it can produce a force for pressure clamping the L-shaped split ferrite core bodies 30*a*, 30*b* together, and although there is imposed no limitation to the material therefor, a metal or a resin that has a certain degree of elasticity is preferred.

The wiring harness 55 comprises a flat cable FC that is put through a slit-like portion 35 formed in the split ferrite core 30 of the noise preventing component 45, the flat cable FC being provided with a cable connector 51. Then, when this wiring harness 55 is installed in the housing of an electronic apparatus, the electronic apparatus can have a construction in which the split ferrite core 30 is held with fixing components 41 in a state in which the L-shaped split ferrite core bodies are assembled together so as to surround the flat cable FC in such a manner that the end face of the longer leg portion of the one of the L-shaped split ferrite core bodies abuts against the side of the shorter leg portion of the other L-shaped split ferrite core body so as to form a closed magnetic path.

According to this fourth embodiment of the present invention, the split ferrite core 30 can be fixedly held at an optimum position on the flat cable FC with the fixing components 41 by changing in any fashion the inside diameter of the slit-like through-hole portion 35 of the split ferrite core 30 that corresponds to the thickness direction of the flat cable FC, whereby it is possible to cope with flat cables of various thicknesses with a few ferrite core configurations. In addition, adoption of the fixing components 41 allows the flat cable FC having passed through the slit-like through-hole portion 35 to be securely clamped and fixed over a wide area when these L-shaped split ferrite core bodies 30*a*, 30*b* are assembled together, and this functions to facilitate attachment of the split ferrite core 30 to the flat cable FC. Other constructions, functions and advantages of this fourth embodiment of the present invention are identical to those of the first embodiment.

Figure 5A:
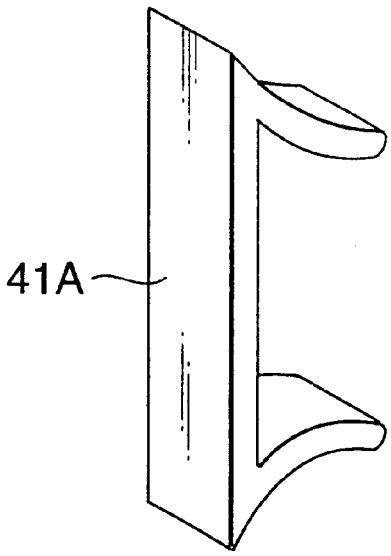
FIGS. 5A and 5B are perspective views showing, respectively, modified examples of a fixing component that can be used in the third and fourth embodiment of the present invention.
Figure 5B:
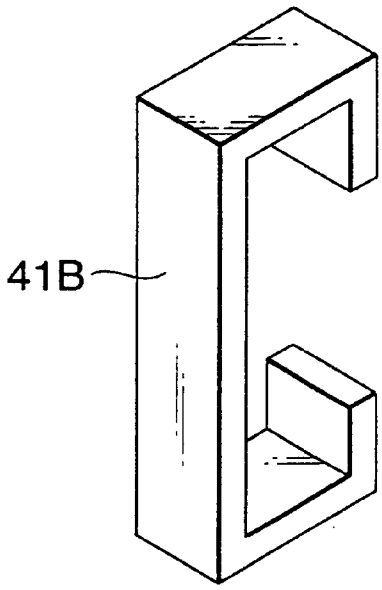

FIGS. 5A and 5B show modifications to the fixing component, and as long as the fixing component has a function to press and hold the L-shaped split ferrite core bodies 20*a*, 20*b* or 30*a*, 30*b* relative to each other, the configuration of either the fixing component 41A shown in FIG. 5A or the component 41B shown in FIG. 5B may be adopted. Although there is imposed no limitation onto the material therefor, a material such as a metal or a resin having a certain degree of elasticity is preferred.

Figure 6:
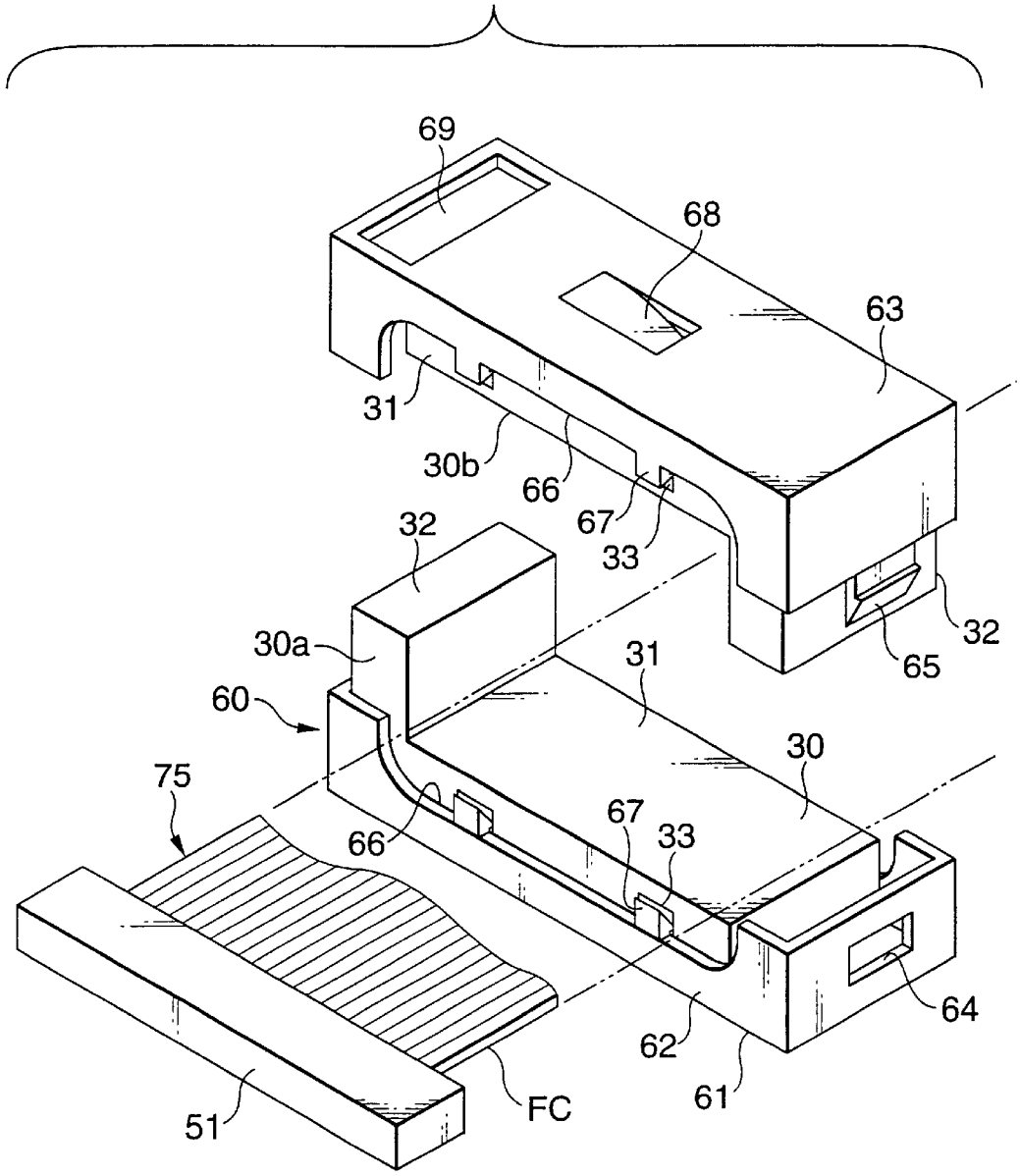
FIG. 6 is a exploded perspective view showing a fifth embodiment of the present invention.
Figure 7:
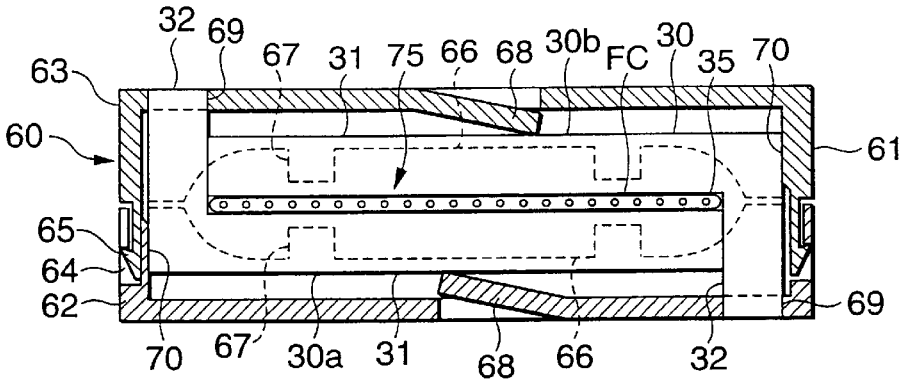
FIG. 7 is a front sectional view of the fifth embodiment of the present invention.

FIGS. 6 and 7 illustrate a fifth embodiment of the present invention in which a further noise preventing component for a flat cable and a further wiring harness are shown. As shown in the figure, the noise preventing component 60 for a flat cable is constructed such that the split ferrite core 30 comprising the L-shaped split ferrite core bodies 30*a*, 30*b* which are assembled together is accommodated in a closable case 61.

The case 61 comprises a first split case part (a case main body) 62 and a second split case part (a case lid part) 63 adapted to be detachably attached to the first split case part, and these split parts may be formed of a metal, a resin or the like, respectively. Provided as a coupling portion on end faces, respectively, of the first and second split case parts 62, 63 is a set of a locking hole 64 and a locking piece 65 adapted to fit in the locking hole 64 so that the two case parts can be coupled to each other. In this construction, when the first and second split case parts 62, 63 are caused to abut with each other for closure of the case 61, the locking hole 64 and the locking piece 65 are coupled to (fitted in) each other so as to serve to hold the case 61 in a closed state. In addition, a notched portion 66 is formed in both the first and second split case parts 62, 63 so that the slit-like through-hole portion 35 of the split ferrite core 30 is exposed when the case 61 is closed, whereby a gap is formed through which the flat cable FC is allowed to pass.

The L-shaped split ferrite core bodies 30*a* and 30*b* are disposed respectively in the first and second split case parts 62 and 63, and locking pawl portions 67 are formed respectively on the first and second split case parts 62, 63 for engagement in holding recessed portions 33 formed at one or a plurality of positions on sides (however, sides normal to sides confronting the flat cable FC) of the longer leg portions 31 of the L-shaped split ferrite core bodies 30*a*, 30*b*. In addition, spring portions 68 are formed in bottom portions of the split case parts 62, 63 so that the L-shaped split ferrite core bodies 30*a*, 30*b* are urged in directions in which the spring portions hold the flat cable FC therebetween. Moreover, windows 69 are formed in bottom portions of the split case parts 62, 63 at positions confronting the shorter leg portions 32 of the respective L-shaped split ferrite core bodies 30*a*, 30*b* in such a manner that the windows do not interfere with movements associated with change in the inside diameter of the slit-like through-hole portion 35 in the thickness direction thereof. Furthermore, provided on internal end faces of the split case parts 62, 63 are positioning raised portions 70 for facilitating the tight contact of the contact surfaces (the end face of the longer leg portion and the side of the shorter leg portion) of the L-shaped split ferrite core bodies 30*a*, 30*b* when the split case parts 62, 63 are coupled to each other.

Attachment of the noise preventing component 60 for a flat cable to the flat cable FC can be effected by accommodating, respectively, the L-shaped split ferrite core body 30a in the first split case part 62 of the opened case 61 and the L-shaped split ferrite core body 30*b* in the second split case part 63, and thereafter fittingly securing the second split case part 63 to the first split case part 62 for closure of the case 61 in such a manner as to hold the flat cable FC therebetween, and thus the wiring harness 75 can be obtained by attaching the noise preventing component 60 to the flat cable FC to which the cable connector 51 is attached in advance. Moreover, when this wiring harness 75 is installed in a housing of an electronic apparatus (for instance, the case 61 is fixed to the housing or a substrate of the electronic apparatus), the electronic apparatus can have a construction in which the split ferrite core 30 is held in an assembled state by the case 61 in which the L-shaped split ferrite core bodies are assembled so as to surround the flat cable FC in such a manner that the end face of the longer leg portion of one of the L-shaped split ferrite core bodies abuts against the side of the shorter leg portion of the other L-shaped split ferrite core body so as to form a closed magnetic path.

In this fifth embodiment of the present invention, the L-shaped split ferrite core bodies 30*a*, 30*b* can easily be attached to the flat cable FC by accommodating and holding them respectively in the split case parts 62, 63 and then assembling the split case parts 62, 63 into an integrated case, and the flat cable FC can be held and fixed within the split ferrite core 30 so as permit no movement thereof.

In addition, the split ferrite core 30 assembled from the L-shaped split ferrite core bodies 30*a*, 30*b* is covered with the case 61, and therefore even if a direct impact is applied to the case 61, since the direct impact is not applied to the ferrite core, it is possible to prevent a damage to the ferrite core. In this case, it is preferable to use a material having a certain degree of elasticity that can absorb an impact applied thereto, such as a resin in particular.

Moreover, since the engagement pawl portions 67 are provided on the respective first and second split case parts 62, 63 for engagement in the holding recessed portions 33 formed respectively in the L-shaped split ferrite core bodies 30*a*, 30*b*, the L-shaped split ferrite core bodies 30*a*, 30*b* can be held in the first and second split case parts 62, 63 in a state in which the former ferrite core bodies are accommodated in the latter case parts. In this respect, also, an operation of attaching the ferrite core to the flat cable FC can be facilitated.

Moreover, provision of the spring portions 68 on the split case parts 62, 63 can serve to impart to each of the L-shaped split ferrite core bodies 30*a*, 30*b* a force to hold the flat cable therebetween when they are attached to the flat cable FC, whereby the flat cable FC can be held by the split ferrite core 30 more securely. In a case where a stronger force is required to be imparted to the L-shaped split ferrite core bodies to hold the flat core FC therebetween, the angle of the spring portions originating respectively from the bottom portions of the split case parts 62, 63 only have to be set to a larger angle.

Other constructions, functions and advantages of the fifth embodiment of the present invention are the same as those of the second mode.

Figure 8A:
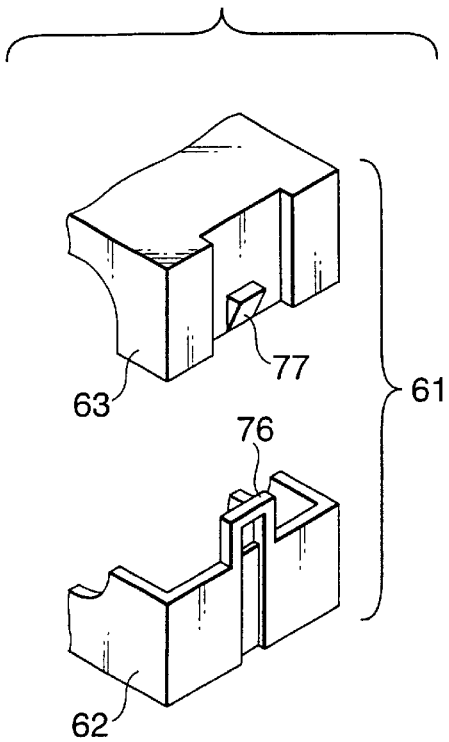
FIGS. 8A and 8B are perspective views showing, respectively, modified examples of a coupling portion of a split case part that can be used in the fifth embodiment of the present invention.
Figure 8B:
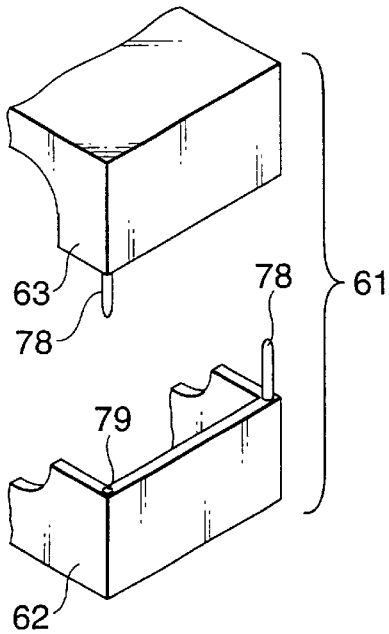

FIGS. 8A and 8B show modifications to the coupling portion between the split case parts 62, 63 constituting the case 61. FIG. 8A shows a construction in which a locking pawl 77 on the side of the split case part 63 is fitted in a tongue piece 76 on the side of the split case part 62 which is provided with a locking hole. On the other hand, FIG. 8B shows a construction in which a fitting pin 78 and a fitting hole 79 are formed on the respective split case parts 62, 63 in such a manner that the fitting pin confronts the fitting hole, and the fitting pin on one of the split case parts is fitted in the fitting hole on the other split case part, whereby the split case parts 62, 63 are fittingly secured to each other. The constructions of the coupling portions shown in FIGS. 8A and 8B may be adopted in the fifth embodiment of the present invention.

Figure 9:
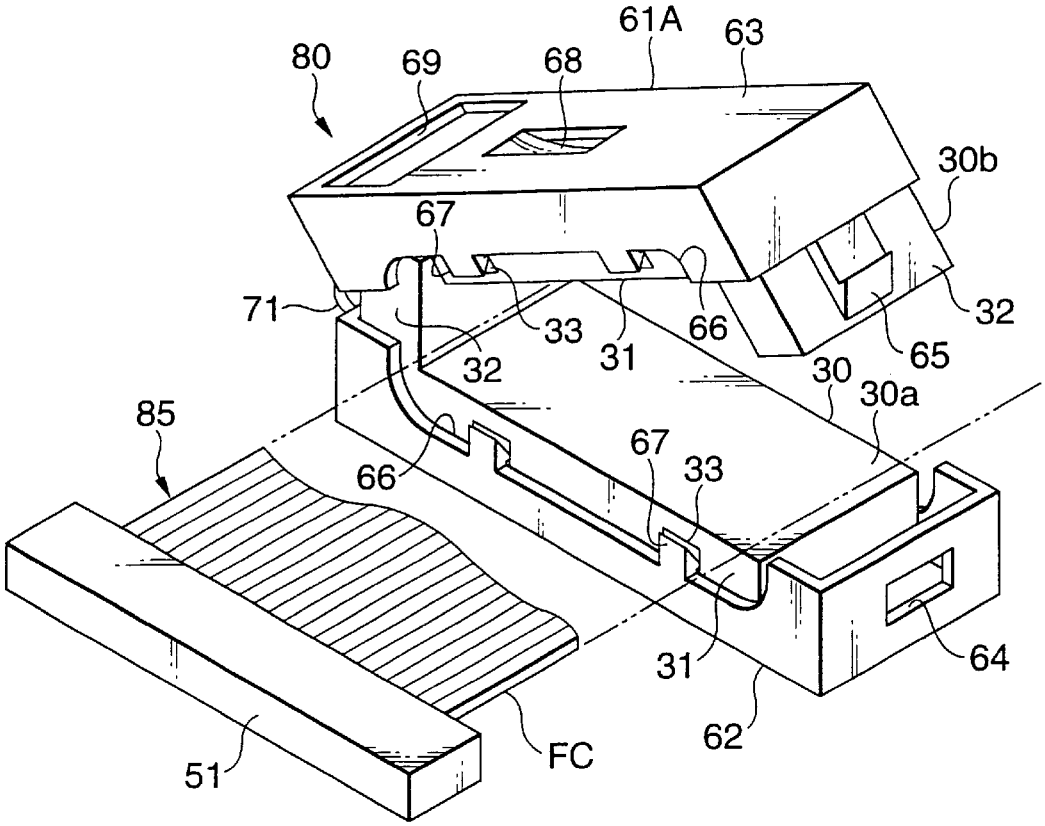
FIG. 9 is an exploded perspective view showing a sixth embodiment of the present invention.

FIG. 9 illustrates a sixth embodiment of the present invention in which another noise preventing component for a flat cable and another wiring harness are shown. In this case, the noise preventing component 80 for a flat cable adopts the split ferrite core 30 constituted by the L-shaped split ferrite core bodies 30*a*, 30*b* which are caused to abut against each other, and used as constituent elements constituting a case 61A that can freely be opened and/or closed are a first split case part (a case main body) 62, a second split case part (a case lid part)63 and a hinge portion 71 for integrally coupling the two split case parts to each other in such a manner that they can freely be opened and/or closed, the first and second split case parts 62, 63 being formed from a resin or the like which has a certain degree of flexibility. Other constructions of this six embodiment of the present invention are the same as those of the fifth embodiment described above, and like reference numerals are given to like or corresponding portions to those described with respect to the fifth embodiment, descriptions thereof being thereby omitted.

According to this sixth embodiment of the present invention, there is provided an integral-type case construction, and with this construction, the noise preventing component can be attached to the flat cable FC as a single component, and therefore this serves not only to improve the working efficiency but also to facilitate provision of the wiring harness 85 in which the noise preventing component 80 is attached to the flat cable FC. Moreover, when this wiring harness 85 is installed into the housing of an electronic apparatus (for instance, the case 61A is fixed to the housing or substrate of the electronic apparatus), the electronic apparatus can have a construction in which the split ferrite core 30 is held in an assembled state by the case 61A in which the L-shaped split ferrite core bodies are assembled so as to surround the flat cable FC in such a manner that the end face of the longer leg portion of one of the L-shaped split ferrite core bodies abuts against the side of the shorter leg portion of the other L-shaped split ferrite core body so as to form a closed magnetic path. In addition, since the case 61A is constructed as an integral body, labor hours can be reduced in production of the components and management of such production.

It is needless to say that there will be caused no problem even if the construction of the coupling portion shown in FIG. 8 is adopted on a side of the case 61A which is opposite to the side where the hinge portion 71 is provided.

In the aforesaid fifth and sixth embodiments of the present invention, the L-shaped split ferrite core body may be fixed inside the split case part with an adhesive tape or an adhesive, and in this case, since it is difficult to provide the spring portion 68, an elastic member is interposed between the L-shaped split ferrite core body and the split case part for adhesion thereat so that an effect can be obtained which is similar to that which would be obtained with the spring portion 68 being provided. In addition, the force for clamping the flat cable can be adjusted through selection of material, thickness and area for the elastic member.

In addition, in the above-mentioned fifth and sixth embodiments, the positioning raised portion 70 may be formed into the shape of a spring.

Figure 10A:
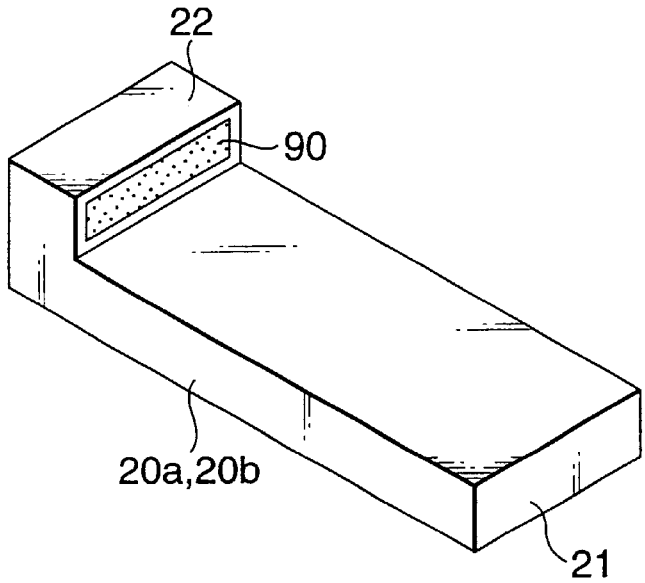
FIGS. 10A and 10B are perspective views showing a seventh embodiment of the present invention.
Figure 10B:
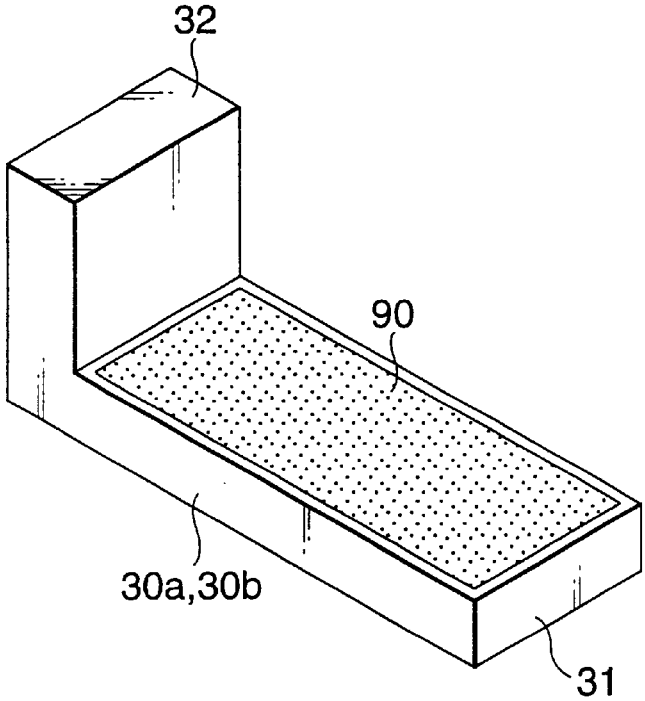

FIGS. 10A and 10B illustrate a seventh embodiment of the present invention in which a slip preventive portions 90 formed from a material having a high frictional force is shown as being provided on the L-shaped split ferrite core bodies 20*a*, 20*b* or 30*a*, 30*b* that constitute a further noise preventing split ferrite core for a flat cable. In other words, the slip preventive portions 90 is provided or stuck on side portions of the L-shaped split ferrite core bodies 20*a*, 20*b* shown in FIG. 10A or the L-shaped split ferrite core bodies 30*a*, 30*b* with which the flat cable is brought into contact, whereby the flat cable can be held motionlessly more effectively when a clamping force is applied by the L-shaped split ferrite core bodies. In addition, there is imposed no particular limitation onto the material for the slip preventive portions 90, but it is preferable to use a flexible material, such as a rubber, having a high frictional force.

The aforesaid slip preventive portions 90 is not provided on the contact surfaces where the L-shaped split ferrite core bodies are brought into contact with each other. For instance, with the L-shaped split ferrite core bodies 20*a*, 20*b*, the slip preventive portions 90 is not disposed on the side position of the longer leg portion with which the end face of the shorter leg portion is brought into abutment.

It is clear that the construction can be applied to the aforesaid first to sixth embodiments of the present invention in which the slip preventive portions 90 is provided on the L-shaped split ferrite core bodies.

Figure 11A:
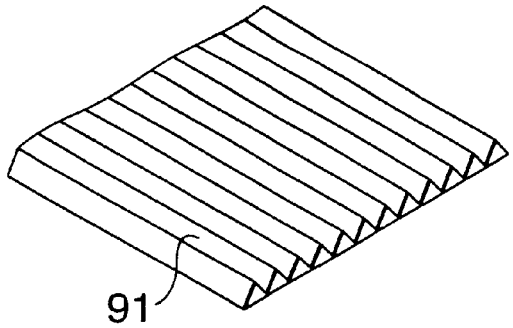
FIGS. 11A, 11B, and 11C are perspective views showing, respectively, modified examples of a slip preventive portions that can be used in the seventh embodiment of the present invention.
Figure 11B:
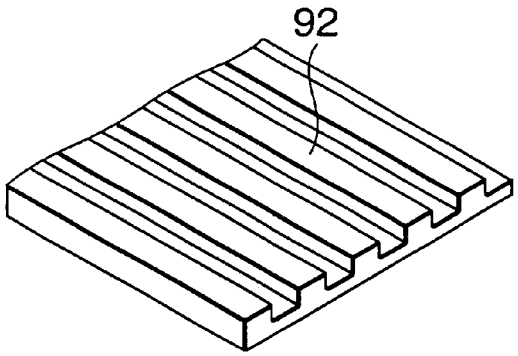
Figure 11C:
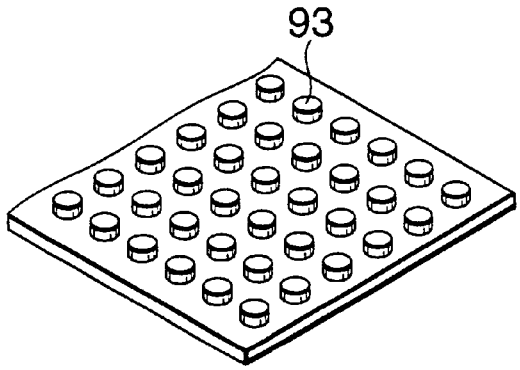
Figure 12:
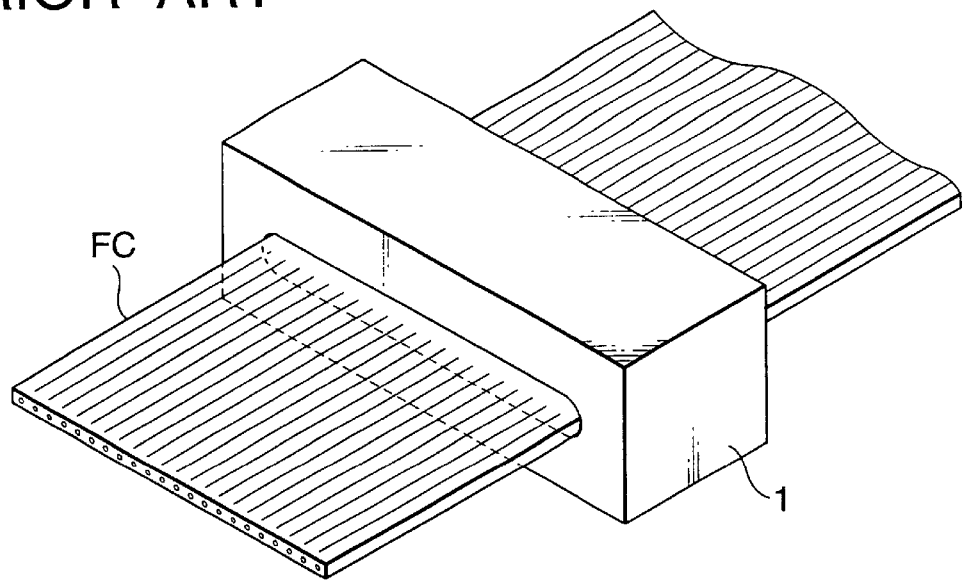
FIG.12 PRIOR ART
FIG. 12 is a perspective view showing an example of a noise preventing component using a conventional integral-type ferrite core.
Figure 13:
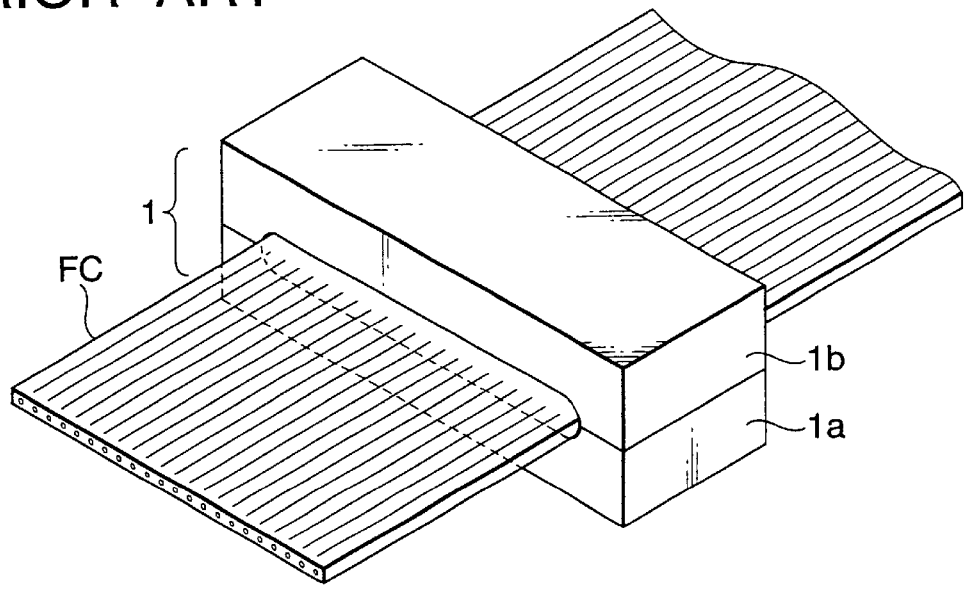
FIG.13 PRIOR ART
FIG. 13 is a perspective view showing an example of a noise preventing component using a conventional split-type ferrite core.
Figure 14:
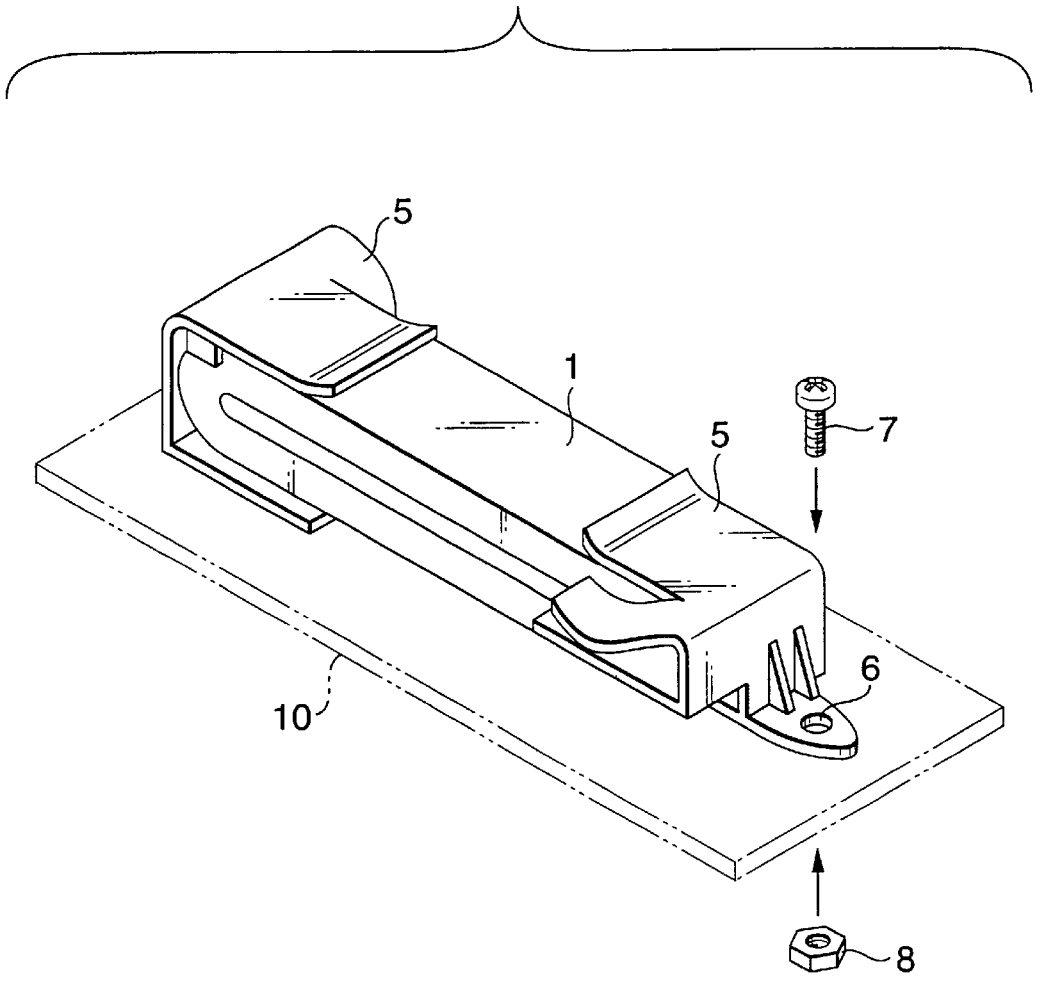
FIG.14 PRIOR ART
FIG. 14 is a perspective view showing an example of a noise preventing component using components for fixing a conventional ferrite core.
Figure 15:
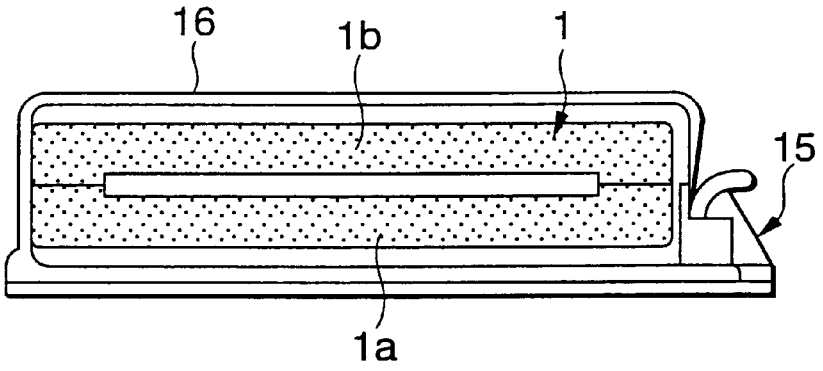
FIG.15 PRIOR ART
FIG. 15 is a front view showing an example of a noise preventing component using components for fixing a conventional split-type ferrite core.
Figure 16:
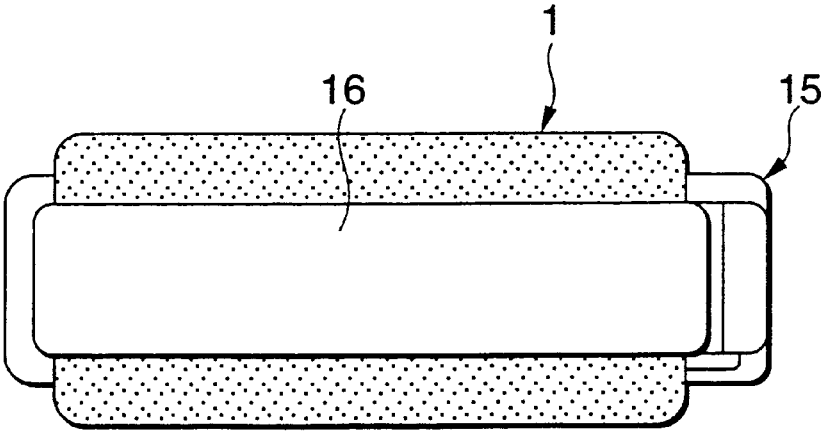
FIG.16 PRIOR ART
FIG. 16 is a plan view of the example of the noise preventing component using the components for fixing the conventional split-type ferrite core.

FIGS. 11A, 11B and 11C illustrate specific examples of the slip preventive portions 90, in which FIG. 11A shows a pattern in which triangular elongated projections are provided in a repeated fashion, FIG. 11B shows a pattern in which square elongated projections are provided in a repeated fashion, and FIG. 11C show a pattern in which cylindrical projections are provided in a repeated fashion. Thus, with those slip preventive portions it is possible to increase the frictional force further.

Furthermore, the split ferrite core 20 may be accommodated in the case illustrated in the above-described fifth and sixth modes so as to constitute a noise preventing component for a flat cable, the split ferrite core 20 comprising the L-shaped split ferrite core bodies 20*a*, 20*b* that are assembled together in such a manner that the end face of the shorter leg portion 22 of one of the L-shaped split ferrite core bodies, which is the L-shaped ferrite core body 20*a*, abuts with the side of the longer leg portion 21 of the other split ferrite core body 20*b* so as to form a closed magnetic path.

Thus, the embodiments of the present invention have been described heretofore, but the present invention is not limited to them, and it is apparent to those skilled in the art to which the present invention pertains that the present invention may be modified or altered in various fashions without departing from the scope of the claims described herein.

For example, the shape of a ferrite core body can be modified into T-shaped or I-shaped (See FIGS. 1B, 1C, and 2B) in order to comply with various kinds of electronic apparatus if the assembled split ferrite core bodies form a closed magnetic path and at least two flat surfaces. However, if the shape of a ferrite core body is L-shaped, a split ferrite core can be assembled without other ferrite core bodies formed into other shapes.

As has been described heretofore, according to the present invention, the noise preventing split ferrite core for a flat cable is used in order to prevent noise from a flat cable, the noise preventing split ferrite core comprising the L-shaped split ferrite core bodies assembled together in such a manner that the end face of the leg portion of one of the L-shaped split ferrite core bodies abuts with the side of the leg portion of the other L-shaped split ferrite core body so as to form a closed magnetic path, whereby it is possible not only to cope with flat cables of various dimensions but also to fix the flat cable by holding it within the split ferrite core. In addition, since a high impedance can be obtained, it is possible to realize a noise preventing component that is easy to be attached and which can prevent noise in an effective fashion, thereby making it possible to provide a wiring harness and an electronic apparatus, for example, personal computers, having the noise preventing component installed therein.

The present invention is based on Japanese Patent Application No. Hei. 10-361968 which is incorporated herein by reference.

What is claimed is:

1. A split ferrite core comprising:

a first split ferrite core body including first and second leg portions, said first leg portion being substantially vertical with respect to said second leg portion; and a second split ferrite core body including third and fourth leg portions, said third leg portion being substantially vertical with respect to said fourth leg portion, wherein said first leg portion of said first split ferrite core body abuts against said fourth leg portion of said second split ferrite core body, and said second leg portion of said first split ferrite core body abuts against said third leg portion of second split ferrite core body;

wherein said split ferrite core is a closed circuit.

2. The split ferrite core according to claim 1, wherein at least one of said first and second split ferrite core bodies is L-shaped.

3. The split ferrite core according to claim 1, wherein at least one of said first and second split ferrite core bodies is T-shaped.

4. The split ferrite core according to claim 1, wherein at least one of said first and second split ferrite core bodies is I-shaped.

5. The split ferrite core according to claim 1, wherein said first and second split ferrite core bodies further include slip preventive portions on at least one of said first, second, third and forth leg portions.

6. The split ferrite core according to claim 5, wherein said slip preventive portions are made of rubber.

7. The split ferrite core according to claim 5, wherein said slip preventive portions have a pattern in which triangular elongated projections are provided in a repeated fashion.

8. The split ferrite core according to claim 5, wherein said slip preventive portions have a pattern in which square elongated projections are provided in a repeated fashion.

9. The split ferrite core according to claim 5, wherein said slip preventive portions have a pattern in which cylindrical projections are provided in a repeated fashion.

10. A noise preventing component for a flat cable comprising:

a split ferrite core including:

a first split ferrite core body including first and second leg portions, said first leg portion being substantially vertical with respect to said second leg portion; and a second split ferrite core body including third and fourth leg portions, said third leg portion being substantially vertical with respect to said fourth leg portion, wherein said first leg portion of said first split ferrite core body abuts against said fourth leg portion of second split ferrite core body, and said second leg portion of said first split ferrite core body abuts against said third leg portion of second split ferrite core body, and at least one fixing component holding said first and second split ferrite core bodies assembled;

wherein said split ferrite core is a closed circuit.

11. The noise preventing component according to claim 10, wherein said fixing component is a clip member which can hold said split ferrite core.

12. The noise preventing component according to claim 10, wherein said fixing component is a case which can accommodate said split ferrite core therein.

13. The noise preventing component according to claim 12, wherein said case includes two split case members.

14. The noise preventing component according to claim 12, wherein said case is an integral-type case including two case bodies connected to each other at a hinge portion.

15. The noise preventing component according to claim 12, wherein said case includes at least one pawl portion which hold said split ferrite core.

16. The noise preventing component according to claim 12, wherein said case includes at least one spring portion pressing said split ferrite core bodies inwardly.

17. The noise preventing component according to claim 10, wherein said fixing component is made of resin.

18. The noise preventing component according to claim 10, wherein said fixing component is made of metal.

19. A wiring harness comprising:

a flat cable, a split ferrite core surrounding said flat cable to fix said flat cable by applying a force to said flat cable, said split ferrite core including:

a first split ferrite core body including first and second leg portions, said first leg portion being substantially vertical with respect to said second leg portion; and a second split ferrite core body including third and fourth leg portions, said third leg portion being substantially vertical with respect to said fourth leg portion, wherein said first leg portion of said first split ferrite core body abuts against said forth leg portion of second split ferrite core body, and said second leg portion of said first split ferrite core body abuts against said third leg portion of second split ferrite core body; and at least one fixing component holding said first and second split ferrite core bodies assembled;

wherein said split ferrite core comprises a closed circuit.

20. An electronic apparatus comprising:

a flat cable, a split ferrite core surrounding said flat cable to fix said flat cable by applying a force to said flat cable, said split ferrite core including:

a first split ferrite core body including first and second leg portions, said first leg portion being vertical with respect to said second leg portion; and a second split ferrite core body including third and fourth leg portions, said third leg portion being vertical with respect to said fourth leg portion, wherein said first leg portion of said first split ferrite core body abuts against said fourth leg portion of second split ferrite core body, and said second leg portion of said first split ferrite core body abuts against said third leg portion of second split ferrite core body; and at least one fixing component holding said split ferrite core body assembled;

wherein said split ferrite cored is a closed circuit.

* * * * *